US006793303B2

(12) United States Patent
Ikeda

(10) Patent No.: US 6,793,303 B2
(45) Date of Patent: Sep. 21, 2004

(54) RECORDING APPARATUS

(75) Inventor: Yasuhiko Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/230,214

(22) Filed: Aug. 29, 2002

(65) Prior Publication Data

US 2003/0048325 A1 Mar. 13, 2003

(30) Foreign Application Priority Data

Sep. 7, 2001 (JP) ..... 2001-272061

(51) Int. Cl.[7] ..... B41J 3/00; B41J 2/165
(52) U.S. Cl. ..... 347/4; 347/27
(58) Field of Search ..... 347/4, 27, 94; 400/319

(56) References Cited

U.S. PATENT DOCUMENTS 5,332,321 A * 7/1994 Beauchamp et al. ..... 400/354
6,172,690 B1 * 1/2001 Angulo et al. ..... 347/19
6,244,765 B1 * 6/2001 Harriman et al. ..... 400/319

OTHER PUBLICATIONS

Patent Abstracts of Japan, vol. 1996, No. 05, May 31, 1996 (JP 08–002053, Jan. 9, 1996).
Patent Abstracts of Japan, vol. 010, No. 037 (M–453), Feb. 14, 1986 (JP 60–190373, Sep. 27, 1985).
Patent Abstracts of Japan, vol. 2000, No. 21, Aug. 3, 2001 (JP 2001–096764, Apr. 10, 2001).
Patent Abstracts of Japan, vol. 1998, No. 06, Apr. 30, 1998 (JP 10–035051, Feb. 10, 1998).
Patent Abstracts of Japan, vol. 015, No. 493 (M–1191), Dec. 13, 1991 (JP 03–215068, Sep. 20, 1991).
Patent Abstracts of Japan, vol. 2000, No. 20, Jul. 10, 2001 (JP 2001–0710463, Mar. 21, 2001).

* cited by examiner

*Primary Examiner*—Stephen D. Meier
*Assistant Examiner*—Alfred Dudding
(74) *Attorney, Agent, or Firm*—Fitzpatrick, Cella, Harper & Scinto

(57) ABSTRACT

A recording apparatus is provided with a damper that attenuates vibrations from a driving source and a driving power transmission mechanism when the vibrations are transmitted to a carriage. The damper is structured to make the attenuation effect larger in the direction other than the traveling direction of the carriage so as to attenuate the vibrations from the driving source and the driving power transmission mechanism mainly in the direction other than the traveling direction of the carriage.

11 Claims, 6 Drawing Sheets

RECORDING APPARATUS

BACKGROUND OF THE INVENTION

1. Field of the Invention

The present invention relates to a recording apparatus that records on a recording medium by reciprocating a recording head to scan.

2. Related Background Art

A recording apparatus provided with the function of a printer, a copying machine, a facsimile, or the like or a recording apparatus used as the output device of a complex type electronic equipment or a work station including a computer, a word processor, or the like is structured to record images on a recording material (recording medium), such as paper sheet, thin plastic plate, in accordance with image information.

Of the recording apparatuses of the kind, the recording apparatus of serial scan type is, in general, such that a recording head is mounted on a carriage, and that the head is allowed to scan when the carriage is driven. The recording apparatus of line type uses the recording head, the recording element of which is arranged over the enter width of the recording area of a recording medium. Then, while the recording medium is being conveyed intermittently at a designated pitch corresponding to the size of the recording element, the recording element is driven for recording on the recording medium when the conveyance of the recording medium is at rest.

For the serial scan type recording apparatus, it is extremely important to perform the scanning of the recording head stably, that is, to stabilize the behavior of the carriage for the serial scanning, in order to obtain the clear and high-quality result of recording. Particularly, the vibration of the motor that serves as a driving source to drive the carriage, and the vibration that occurs due to the engagement of a belt with a pulley for the transmission of driving power from the motor are factors that make the behavior of the carriage unstable.

For the conventional recording apparatus of serial scan type, therefore, the structure is formed to arrange an elastic member capable of being elastically deformed in the traveling direction of a carriage between the carriage and a belt or a member that fixes the belt to the carriage, hence attenuating the vibrations resulting from the operation of the motor and belt.

For the conventional structure described above, however, the elastic member is arranged to make the elastic deformation in the traveling direction of the carriage. Consequently, the positional deviation of the carriage ultimately becomes greater in the traveling direction of the carriage, thus causing the resultant problems identified below.

(1) Response capability is lowered when actuated.
(2) The carriage vibrates when it is driven.
(3) Positional deviation occurs when carriage stops.

These problems not only result in lowering the stability of the carriage operation, but also lead to lowered throughput. Particularly, in recent years, it has been required for a recording apparatus to record at higher speed. Here, the lowered stability of the carriage operation and the lowered throughput make it difficult to attain the compatibility of high-quality recording and high-speed recording.

SUMMARY OF THE INVENTION

It is an object of the present invention to provide a recording apparatus capable of suppressing the positional deviation of the carriage, while attenuating vibrations transmitted from the driving source of the carriage effectively.

It is another object of the invention to provide a recording apparatus provided with a damper capable of attenuating vibrations transmitted to a carriage from the driving source and the driving power transmission mechanism, which is structured to make the attenuation effect larger in a direction other than the traveling direction of the carriage so that the vibrations from the driving source and the power transmission mechanism are attenuated mainly by the attenuation effect in a direction other than the traveling direction of the carriage.

It is still another object of the invention to provide a recording apparatus which comprises a conveying mechanism for conveying a recording material; a carriage for holding a recording head portion for recording on a recording material movably provided to reciprocate in a direction intersecting with the recording material conveying direction of the conveying mechanism; a driving source for generating driving power to enable the carriage to reciprocate; a driving power transmission mechanism for transmitting driving power from the driving source; and a damper for attenuating vibrations transmitted to the carriage through the driving power transmission mechanism, the damper being structured to make the attenuation effect larger in a direction not parallel to the traveling direction of the carriage than in the traveling direction of the carriage.

DETAILED DESCRIPTION OF THE PREFERRED EMBODIMENTS

Hereinafter, with reference to the accompanying drawings, the specific description will be made of the embodiments in accordance with the present invention.

Figure 1:
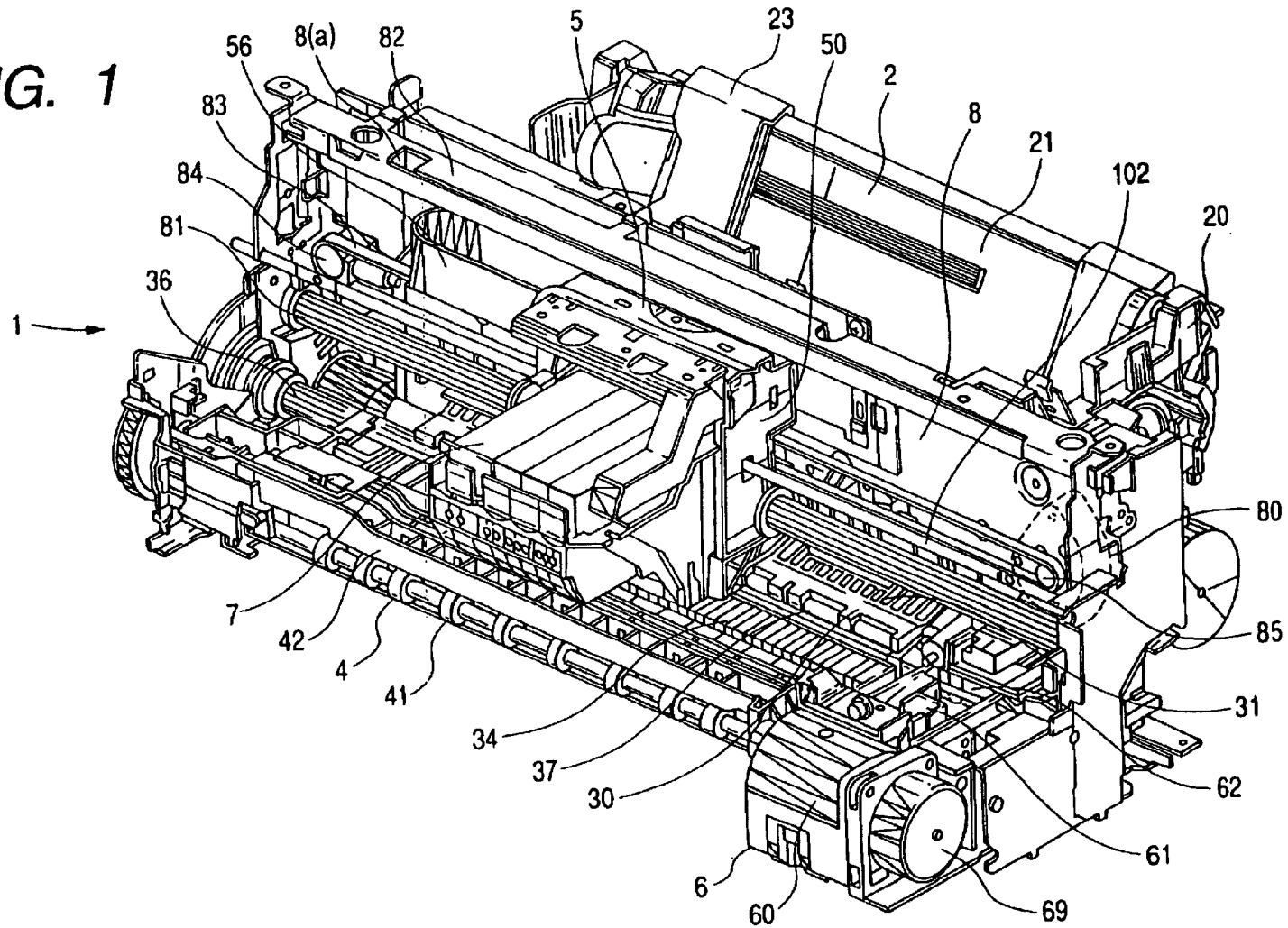
FIG. 1 is a perspective view that shows the entire structure of a recording apparatus embodying the present invention.
Figure 2:
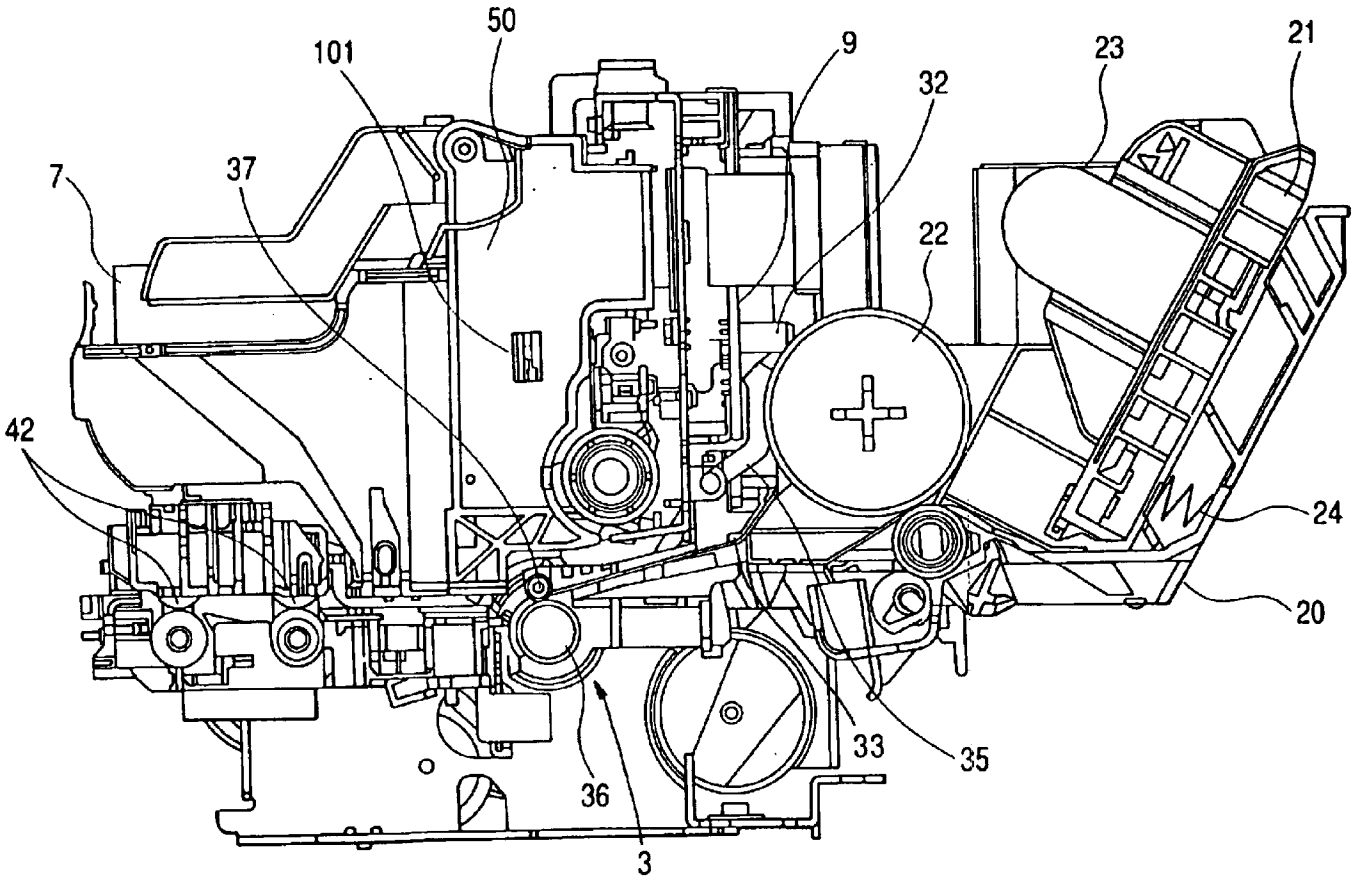
FIG. 2 is a side sectional view that shows the recording apparatus represented in FIG. 1.

At first, FIG. 1 and FIG. 2 schematically illustrate the structure of a recording apparatus embodying the present invention.

FIG. 1 is a perspective view that shows the entire structure of the recording apparatus. FIG. 2 is a side sectional view of the recording apparatus. The recording apparatus 1, which is provided with an automatic feeding device, comprises a sheet-feeding portion 2, a sheet-conveying portion 3, and a sheet-expeller portion 4, a carriage 5, and a cleaning portion 6. Now, the brief description will be made of them one after another by dividing them into each item.

In FIGS. 1 and 2, the sheet-feeding portion 2 is structured by a pressure plate 21 on which recording sheets are stacked, and a sheet-feeding rotational member 22 that feeds each recording sheet, which are fixed to a base 20. For the pressure plate 21, a movable side guide 23 is movably provided to regulate the stacking position of the recording sheets. The pressure plate 21 is rotative centering on the shaft coupled with the base 20, which is biased to the sheet-feeding rotational member 22 by use of a pressure plate spring 24.

The sheet-conveying portion 3 is provided with a conveying roller 36 and a PE sensor 32 for conveying a recording medium. The conveying roller 36 is provided with a driven pinch roller 37 that abuts against it. The pinch roller 37 is supported by a pinch roller guide 30, and biased by a pinch roller spring 31 to be pressed to the conveying roller 36, thus generating power to convey a recording sheet. Further, at the entrance of the sheet-conveying portion 3, to which a recording medium is conveyed, there is arranged a platen 34 that guides the recording sheet. Also, for the pinch roller guide 30, the PE sensor lever 35 is provided to transmit the detection of the leading end and trailing end of the recording sheet to the PE sensor 32. Further, on the downstream side of the conveying roller 36 in the recording sheet conveying direction, the head cartridge 7 is installed, which forms images in accordance with image information.

With the structure thus arranged, the recording sheet that has been conveyed to the sheet-conveying portion 3 is guided and carried by the platen 34, the pinch roller guide 30, and the upper guide 33 to the roller pair of the conveying roller 36 and the pinch roller 37. At this juncture, the PE sensor lever 35 detects the leading end of the recording sheet thus conveyed thereto. In this way, the printing position of the recording sheet is secured. Also, the recording sheet is conveyed on the platen 34 by the roller pair 36 and 37, which rotates by use of an LF motor (not shown).

Here, in this case, an ink jet recording head, for which ink tanks are exchangeable, is used as the head cartridge 7. The head cartridge 7 is capable of providing thermal energy for ink by use of a heater or the like that serves as the electrothermal converting element that generates heat when electric power is supplied. Then, by the heat thus generated, film boiling occurs in the ink, and by the pressure changes resulting from the growth and shrinkage of bubbles generated by the film boiling, ink droplets are discharged from the nozzle (ink discharge port) of the head to form images on the recording sheet.

The carriage portion 5 is provided with the carriage 50 on which the head cartridge 7 is installed. The carriage 50 is supported by the guide shaft 81 arranged to reciprocate scanning in the direction at right angles to the conveying direction of the recording sheet, and also, by the guide rail 82, which keeps a gap between the recording head 7 and the recording sheet by holding the upper rear end of the carriage 50. In this respect, the guide shaft 81 and the guide rail 82 are fixed to a chassis 8. Also, for the chassis 8, a regulating portion 8*a* is folded up to regulate the range in which the carriage moves to the left.

The carriage 50 is driven by the carriage motor 80, which is fixed to the chassis 8 through a timing belt 83. The timing belt 83 is tensioned and supported by an idle pulley 84. Further, the carriage 50 is provided with a flexible cable 56 for transmitting head signals from an electric base plate 9 to the head cartridge 7. Also, on the carriage 50, a linear encoder 101 is installed to detect the position of the carriage, and by reading line numbers of the linear scale 102, which is fixed to the chassis 8, the carriage position can be detected. The signals from the linear encoder 101 are transmitted to the electric base plate 9 for processing through the flexible cable 56.

With the structure thus arranged, when images are formed on a recording sheet, the head cartridge 7 is allowed to face the position of image formation by conveying the recording sheet by use of the roller pair 36 and 37 to the line position where images are formed (position in the conveying direction of the recording sheet), while moving the carriage 50 to the column position (position in the direction orthogonal to the conveying direction of the recording sheet) where images are formed by the feedback control using the carriage motor 80 and the linear encoder 101. After that, the head cartridge 7 discharges ink droplets to the recording sheet in accordance with signals from the electric base plate 9.

In the sheet-expeller portion 4, a spur 42, which is driven to rotate following the rotation of a sheet-expeller roller 41, is arranged to abut against the sheet-expeller roller 41. With the structure thus arranged, the recording sheet, on which the carriage portion 5 forms images, is nipped and conveyed by the sheet-expeller roller 41 and the spur 42 and expelled to a sheet-expeller tray or the like (not shown).

The cleaning portion 6 comprises a pump 60 for cleaning the head cartridge 7; a cap 61 for preventing ink droplets from being dried in the ink discharge port of the head cartridge 7; a wiper 62 for cleaning the face end of the head cartridge (the surface where ink discharge ports are arranged); and a PG motor 69 serving as the driving source.

So far, the description has been made of the entire structure of the recording apparatus 1 embodying the present invention. Next, with reference to FIGS. 3, 4 and 5, the detailed description will be made of the structure of the characteristic part of the present invention in the carriage portion 5 where the carriage 50 and the timing belt 83 are installed.

Figure 3:
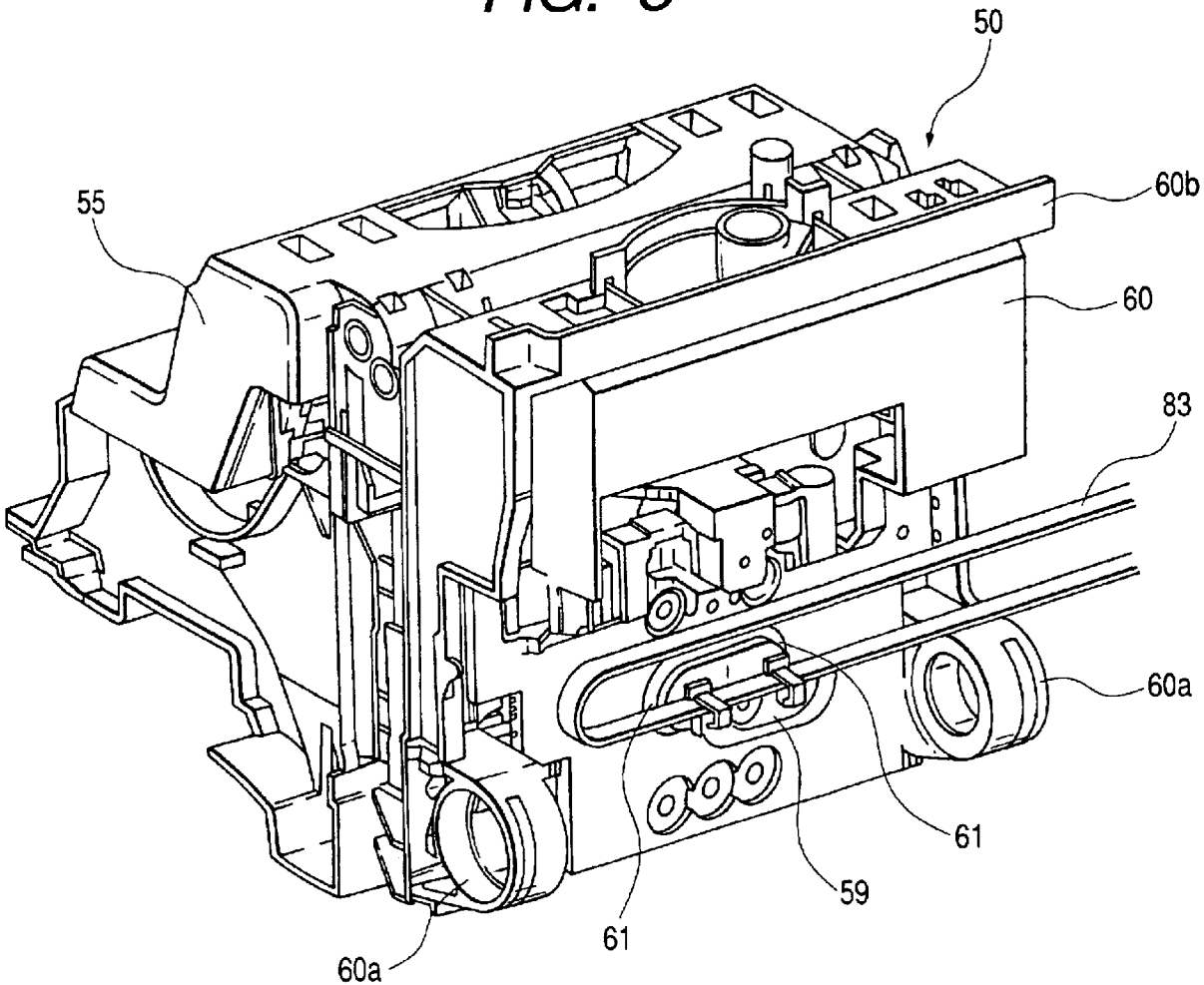
FIG. 3 is a perspective view that shows the carriage portion of the recording apparatus represented in FIG. 1, observed from the backside thereof.
Figure 4:
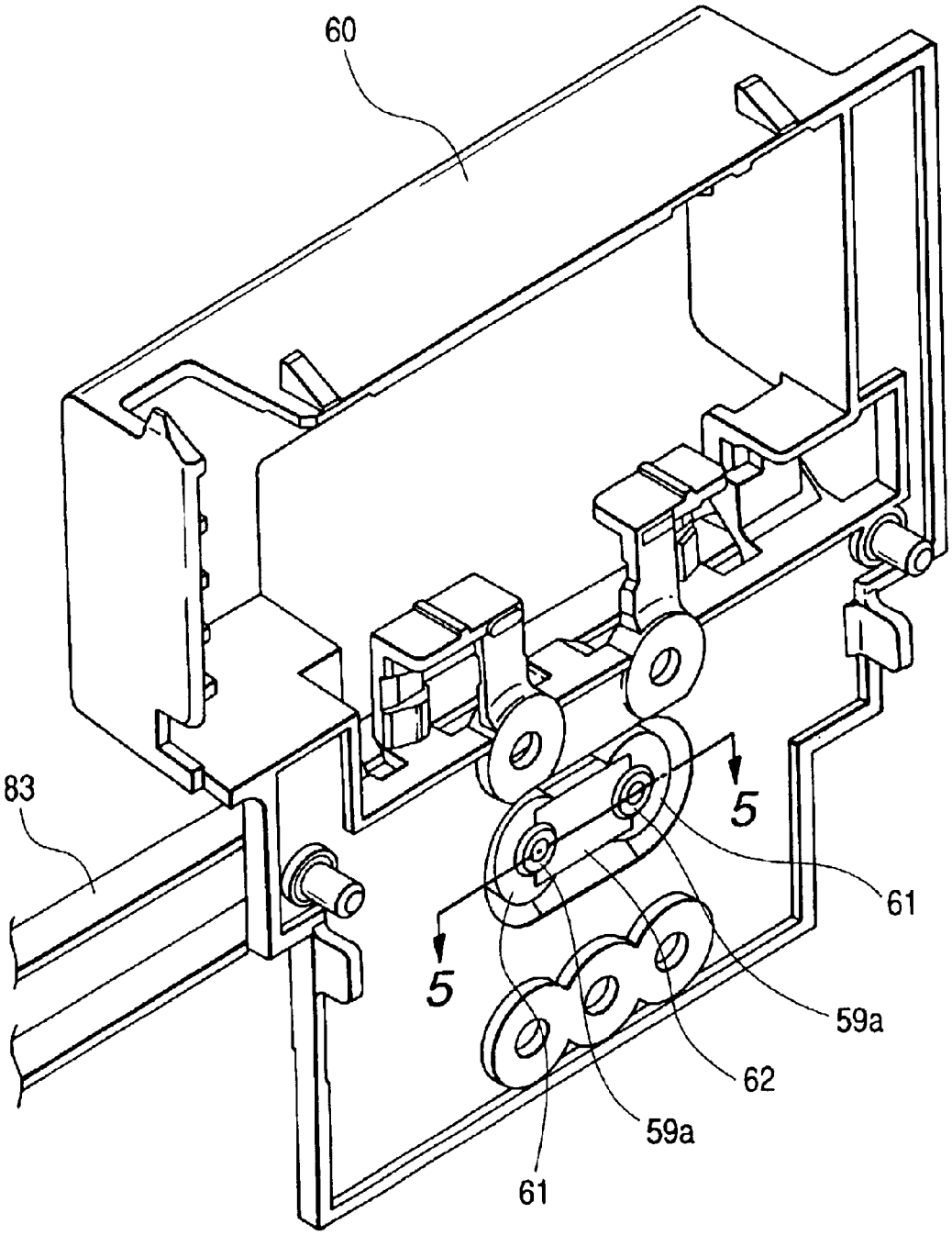
FIG. 4 is a perspective view that shows the recording apparatus represented in FIG. 1, observed from the front side in a state where the carriage main body is removed from the carriage thereof.
Figure 5:
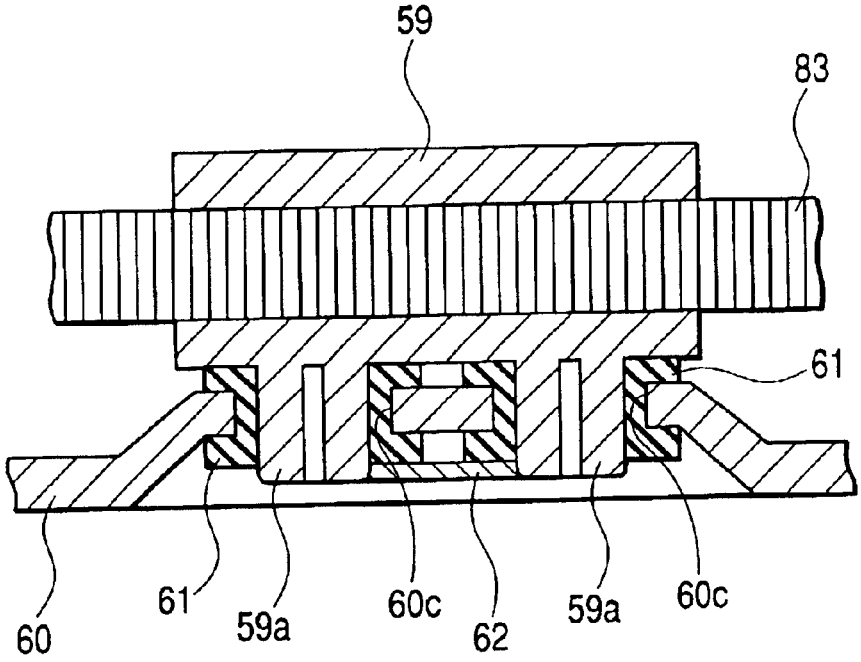
FIG. 5 is a cross-sectional view taken along line 5—5 in FIG. 4;.

FIG. 3 is a perspective view that shows the carriage portion 5 of the recording apparatus 1 of the present embodiment, observed from the backside thereof. Also, FIG. 4 is a perspective view observed from the front side in a state where a rear cover 60 is left after having removed the carriage main body 55 from the carriage 50. FIG. 5 is a cross-sectional view taken along line 5—5 in FIG. 4.

As shown in FIG. 3, the carriage 50 is mainly provided with the carriage main body 55, and the rear cover 60 fixed to the carriage main body 55 by means of screws, for example. The carriage main body 55 is a portion where the head cartridge 7 (see FIG. 2) is mounted, which includes various kinds of structures for attaching or detaching the head cartridge 7 to or from the carriage 50 and for positioning the carriage. The rear cover 60 supports the carriage 50 movably, while serving as a portion where the timing belt 83 is connected. The rear cover comprises a bearing portion 60*a* that receives the guide shaft 81 (see FIG. 1); a guide rail receiving portion 60*b* that receives the guide rail 82 (see FIG. 1); and a connecting structure for the timing belt 83.

Here, the description will be made of the structure for connecting the carriage 50 and the timing belt 83 further in detail. In accordance with the present embodiment, the structure for connecting the carriage 50 (rear cover 60) and the timing belt 83 comprises a belt holder 59 fixed to the timing belt 83; two dampers 61 that attenuate vibration transmitted from the driving system of the carriage 50 through the timing belt 83; and a fixing member 62 that fixes the dampers 61 to the belt holder 59.

The belt holder 59 is fixed to a part of the timing belt 83 by nipping in the timing belt 83 so as not to allow any deviation to take place in a gap with the timing belt 83. Then, there are provided integrally the two axial portions 59*a* that extend parallel to each other with a gap in the traveling direction of the carriage 50.

On the other hand, for the rear cover 60, two damper fixing holes 60*c* are provided corresponding to the axial portions 59*a* of the belt holder 59. Then, the damper 61, which is formed to be almost cylindrical from an elastic material, such as rubber, is inserted into each of the damper fixing holes 60*c* to attenuate vibrations transmitted to the belt holder 59 through the timing belt 83 by utilization of the elastic deformation of the damper.

Figure 6:
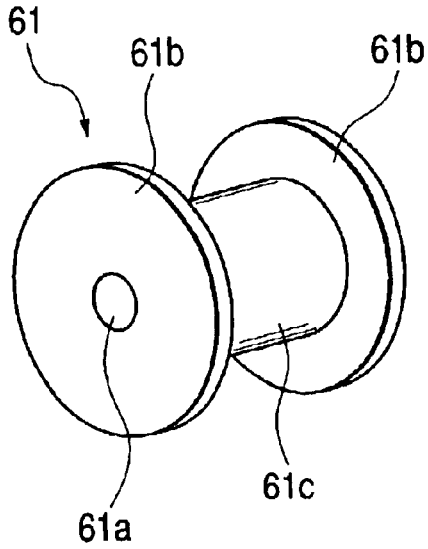
FIG. 6 is a perspective view that shows the damper represented in FIG. 4.

As shown in FIG. 6, the damper 61 comprises a hollow portion 61*a* arranged in the axial direction thereof; two flanges 61*b* installed on the edge portions in the axial direction, respectively; and the middle portion 61*c*, which is an area between the flanges 61*b*. The damper 61 is fixed to the rear cover 60 so that the middle portion 61*c* is held in the damper fixing hole 60*c*. For the present embodiment, the damper 61 is fixed to the rear cover 60 so that the axial direction thereof is in parallel to the conveying direction of a recording sheet in the sheet-conveying portion 3. The elastic material used to form the damper 61 is not necessarily limited, so long as it produces the effect of attenuating vibrations. However, in order to demonstrate the attenuation effect more effectively, it is desirable to select a material from among those having a property to attenuate the vibrations of the particular frequency to be attenuated, in particular, vibrations that affect the behavior of the carriage 50 among the vibrations transmitted through the timing belt 83.

Each axial portion 59*a* of the belt holder 59 is inserted into the hollow portion 61*a* of the damper 61, thus enabling the rear cover 60 to be connected with the belt holder 59 through the damper 61. In this way, this structure is arranged to connect the belt holder 59 and the rear cover 60 by inserting the axial portion 59*a* of the belt holder 59 into the damper fixing hole 60*c* of the rear cover 60 through the damper 61, thus making it possible to connect the belt holder 59 and the rear cover 60 reliably without impeding the attenuation effect of the damper 61.

In a state where the rear cover 60 and the belt holder 59 are connected, one of the two flanges 61*b* of the damper 61 is nipped by the rear cover 60 and the belt holder 59 in the axial direction of the damper 61.

The fixing member 62 is the one that holds the damper 61 fixed to the axial portion 59*a*. Then, in a state where each axial portion 59*a* is inserted into the hollow portion 61*a* of the damper 61, the fixing member 62 is installed on the part of the axial portion 59*a* that extrudes from the damper 61. For the present embodiment, the structure is arranged so that the fixing member 62 is nipped by the two axial portions 59*a* and holds two dampers 61. However, this member may be provided per damper 61.

The outer diameter of the hollow portion 61*c* of the damper 61, and the diameter of the damper fixing hole 60*c* are defined in dimensional relations so that no play takes place between the damper 61 and the rear cover 60 on the plane perpendicular to the axial direction of the damper 61. Also, the gap between the two flanges 61*b* of the damper 61 (the length of the middle portion 61*c* in the axial direction of the damper 61), and the thickness of the rear cover 60 on the circumference of the damper fixing hole 60*c* are defined in dimensional relations so that no play takes place between the damper 61 and the rear cover 60 in the axial direction of the damper 61. Further, the diameter of the axial portion 59*a* of the belt holder 59 and the inner diameter of the hollow portion 61*a* of the damper 61 are defined in dimensional relations so that no play takes place between the axial portion 59*a* and the damper 61 on the plane perpendicular to the axial direction of the damper 61, and the fixing position of the fixing member 62 in the axial direction of the damper 61 should be a position where no play takes place between the damper 61 and the belt holder 59 in the axial direction of the damper 61. Therefore, unless the damper 61 is elastically deformed, the belt holder 59 and the rear cover 60 are held fixedly to each other through the damper 61.

Also, for the present embodiment, the flanges 61*b* are provided for the edge portions of the damper 61, respectively, and on the circumference of the damper fixing hole 60*c*, the rear cover 60 is nipped by these flanges 61*b*. As a result, besides the compression given to the damper 61 in the thickness direction in the middle portion 61*c*, the flanges 61*b* are compressed to make the belt holder 59 and the rear cover 60 relatively displaceable. For example, if the flanges 61*b* are compressed evenly on the entire circumference thereof, the belt holder 59 and the rear cover 60 are relatively displaced in the axial direction of the damper 61, and if pressure is exerted so that a portion of the flanges 61*b* is compressed more than other parts, the belt holder 59 and the rear cover 60 are relatively displaced in a direction so as to be inclined relative to the plane perpendicular to the axial line of damper 61.

In other words, the damper 61 has the function to attenuate vibrations not only in the middle portion 61*c*, but also, in the portions where the flanges 61*b* are arranged. Also, particularly for the present embodiment, two dampers 61 are arranged in parallel in the traveling direction of the carriage 50. Therefore, the present embodiment is structured so that the attenuation effect is larger in the direction that is not in parallel to the traveling direction of the carriage 50, that is, more specifically, the direction at right angles to the traveling direction of the carriage 50, than in the traveling direction of the carriage 50.

The connecting structure described above is assembled as given below, for example. At first, two dampers 61 are inserted into the damper fixing holes 60*c* of the rear cover 60, respectively. Then, two axial portions 59*a* of the belt holder 59 are inserted into the middle portions 61*a* of the dampers 61, respectively. Lastly, the fixing member 62 is installed on the axial portion 59*a* to hold the damper 61.

As described above, in accordance with the present embodiment, the carriage motor 80 (see FIG. 1) is driven. Then, when the carriage 50 travels by use of the timing belt 83, vibrations of the carriage motor 80 and vibrations that occur due to the engagement between the timing belt 83 and the pulleys 84 and 85 are transmitted to the belt holder 59 through the timing belt 83. Here, the belt holder 59 is connected with the carriage 50 (more specifically, with the rear cover 60) through the dampers 61. As a result, the dampers 61 attenuate the vibrations of the belt holder 59, hence suppressing the vibrations of the carriage 50.

Here, as described above, the present embodiment is structured so that the attenuation effect of the dampers 61 is made larger in directions other than the traveling direction of the carriage 50. Therefore, the vibrations of the belt holder 59 are attenuated mainly by the attenuation effect in directions other than the traveling direction of the carriage 50. In this way, while suppressing the phase deviation between the timing belt 83 and the carriage 50 in the traveling direction of the carriage 50, the attenuation effect is obtainable as required. As a result, the stability of the operation of the carriage 50 is enhanced, and the problem of lowered response at the time of actuating the carriage 50 or of positional deviation when the carriage 50 stops is rarely encountered. Therefore, the throughput of the recording apparatus 1 is enhanced, leading to the attainment of recording in high-quality images at high speed. In order to suppress the phase deviation between the timing belt 83 and the carriage 50 more effectively, it is desirable to arrange the structure so that the attenuation effect of the dampers 61 is made larger in the direction at right angles to the traveling direction of the carriage 50.

Also, for the present embodiment, the damper 61 is cylindrical with flanges 61*b*. Therefore, it is extremely easy to fix it by merely fitting it on the axial portion 59*a* of the belt holder 59, thus obtaining a damper 61 having a larger attenuation effect in the direction at right angles to the traveling direction of the carriage 50.

Further, for the present embodiment, the belt holder 59 and the fixing member 62 nip the damper 61, and also, the structure is arranged so that the fixing member 62 is not directly in contact with the rear cover 60. As a result, the vibrations from the timing belt 83 are transmitted through the damper 61 under any circumstances, hence making it possible to obtain a sufficient effect of attenuating vibrations.

Figure 7:
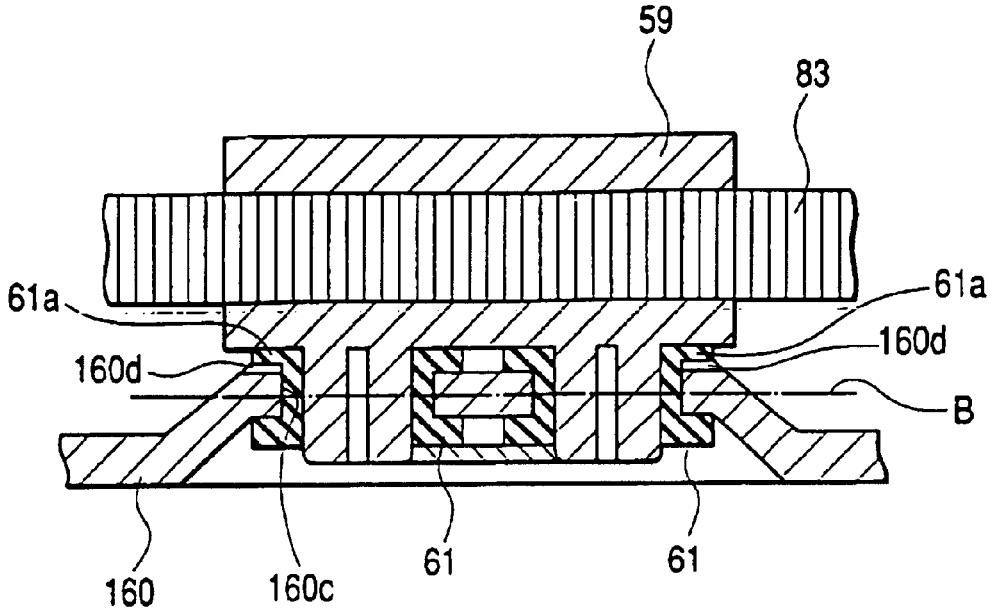
FIG. 7 is a cross-sectional view that shows a recording apparatus in accordance with another embodiment of the present invention, taken in the same manner as FIG. 5.

FIG. 7 is the same cross-sectional view as FIG. 5, which shows a recording apparatus in accordance with another embodiment of the present invention.

The mode shown in FIG. 7 is such that the structure of a rear cover 160 is modified from that of the mode shown in FIG. 5. All other structures are the same as those shown in FIG. 5. Therefore, the detailed description thereof will be omitted. Also, in FIG. 7, the same reference marks designated in FIG. 5 are given to the same parts as those shown in FIG. 5.

In accordance with the present embodiment, an extruded portion 160*d* is provided for a part in the area facing the flange 61*b* of the damper 61 on the circumference of the damper fixing hole 160*c* of the rear cover 160. The height of extrusion of the extruded portion 160*d* is defined to be the compressed height of the flange 61*b* of the damper 61 in the thickness direction between the belt holder 59 and the extruded portion 160*d*. In this way, it becomes possible to eliminate the play completely between the rear cover 160 and the damper 61 in the axial direction of the damper 61, and suppress effectively the vibrations of the rear cover 160 (carriage) due to the vibration of the timing belt 83. Further, the extruded portion 160*d* compresses only a part of the flange 61*b*. As a result, it is made possible to secure a degree of freedom with the other parts of the flange 61*b*, which are compressed, for the relative displacement between belt holder 59 and the rear cover 160 in a direction not parallel to the traveling direction of the carriage. As shown in FIG. 7, for example, with the provision of the extruded portion 160*d* in the direction of the traveling direction of the carriage (directions to the left and the right in FIG. 7), it is made possible for the belt holder 59 and the rear cover 160 to be displaced relatively in the rotational direction of the axial line B parallel to the traveling direction of the carriage. With the degree of freedom of relative displacement thus secured between the belt holder 59 and the rear cover 160, a sufficient attenuation effect is obtainable with respect to vibrations in a direction orthogonal to the traveling direction of the carriage despite the structure in which the flange 61*b* is compressed. In order to make the amount of relative displacement larger between the belt holder 59 and the rear cover 160, it is preferable to provide the extruded portion 160*d* within a plane that is parallel to the traveling direction of the carriage, and also, that is set through the axial line of the damper 61.

For the embodiment shown in FIG. 7, the description has been made of the example in which the extruded portion that compresses the flange 61*b* of the damper 61 is provided for the rear cover 160. However, the extruded portion may be provided for the belt holder 59 or may be provided both for the rear cover 160 and the belt holder 59.

Figure 8:
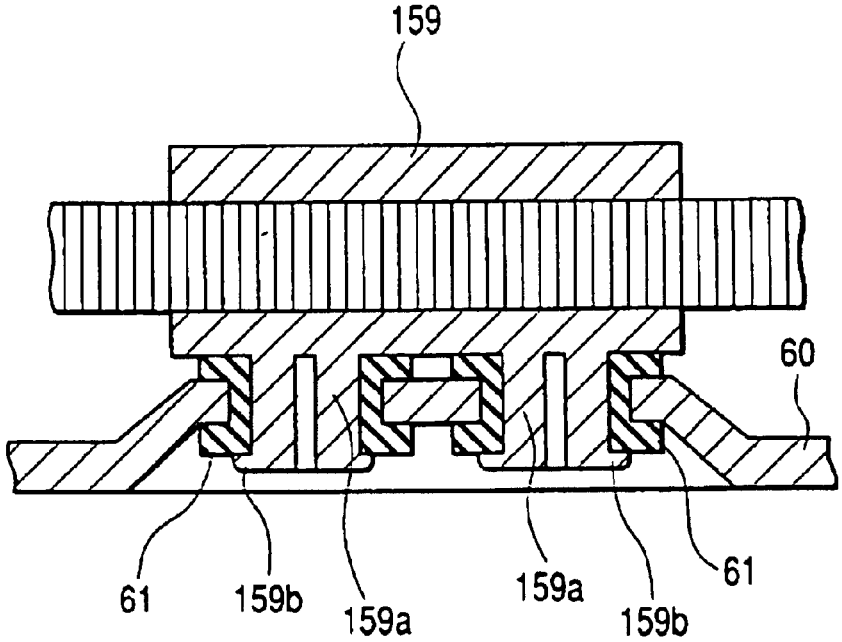
FIG. 8 is a cross-sectional view that shows a recording apparatus in accordance with still another embodiment of the present invention, taken in the same manner as FIG. 5.

FIG. 8 is the same cross-sectional view as FIG. 5, which shows a recording apparatus in accordance with still another embodiment of the present invention. The mode shown in FIG. 8 is such that the structure of the belt holder 159 is modified from that of the mode shown in FIG. 5. All other structures are the same as those shown in FIG. 5. Therefore, the detailed description thereof will be omitted. Also, in FIG. 8, the same reference marks designated in FIG. 5 are given to the same parts as those shown in FIG. 5.

In accordance with the present embodiment, flanges 159*b* are integrally formed with respective leading end portions of axial portions 159*a* of the belt holder 159, and with the flanges 159*b*, it is arranged to prevent the dampers 61 from falling off from the axial portions 159*a*. In this way, it becomes unnecessary to provide the fixing member 62 (see FIG. 5) used for the embodiments described above, hence reducing the cost of manufacture by reducing the number of parts required.

Here, it is desirable not to allow the flange 159*b* to be directly in contact with the rear cover 60. Then, the vibrations from the timing belt 83 are transmitted through the damper 61 under any circumstances, thus obtaining a sufficient effect of attenuating vibrations.

The description has been made of the embodiments of the present invention by exemplifying typical examples. In each of the embodiments described above, examples have been shown in which two dampers 61 are provided in parallel in the traveling direction of the carriage 50. However, if the configuration, arrangement, material, and the like are arranged for the damper 61 so that the attenuation effect in a direction that is not parallel to the traveling direction of the carriage 50 is made larger than the attenuation effect in the traveling direction of the carriage 50, the number of dampers 61 may also be one or three or more. Also, for each of the embodiments described above, a damper formed from elastic material, such as rubber, is shown as the damper 61 of the present invention. However, the damper 61 is not necessarily limited thereto. It may be possible to use a coil spring, flat spring, or the like for a damper. The present invention is equally applicable to a recording apparatus of the ink jet type, thermal type, wire-dot type, or others so long as the recording apparatus is of the serial scanning type. Particularly, in regard to apparatuses of the ink jet type, those that form flying liquid droplets by the utilization of thermal energy make it possible to produce electrothermal converting elements integrally in high density using semiconductor manufacturing technologies and techniques, and to obtain an ink jet head having discharge ports arranged in high density, thus performing image recording in color in high precision.

Furthermore, the mode of a recording apparatus of the present invention may be the one that functions as a copying machine combined with a reader or the like or facsimile equipment provided with transmission and reception functions, in addition to the mode of the image output terminal of a word processor, a computer, or other information processing equipment, irrespective of whether it is integrally provided or independently provided as a separate body.

As described above, in accordance with the embodiments of the present invention, the damper that attenuates the vibrations transmitted to the carriage through the driving power transmission mechanism is formed so that the attenuation effect thereof is made larger in directions other than the traveling direction of the carriage. Thus, while suppressing the phase deviation between the driving power transmission mechanism and the carriage, it is made possible to obtain a required attenuation effect. Therefore, the throughput of recording is enhanced to make high-quality and high-speed recording attainable.

What is claimed is:

1. A recording apparatus comprising:

a conveying mechanism for conveying a recording material;

a carriage for holding a recording head portion for recording on the recording material, said carriage being movably provided to reciprocate in a direction intersecting with a direction in which the recording material is conveyed by said conveying mechanism;

a driving source for generating driving power to enable said carriage to reciprocate;

a driving power transmission mechanism for transmitting the driving power from said driving source; and a damper for attenuating vibrations transmitted to said carriage through said driving power transmission mechanism, wherein said damper is structured to make an attenuation effect larger in a direction at right angles to a traveling direction of said carriage than in the traveling direction of said carriage.

2. A recording apparatus according to claim 1, further comprising:

a connecting member for connecting said driving power transmission mechanism and said carriage, wherein said damper is arranged between said connecting member and said carriage.

3. A recording apparatus according to claim 2, wherein an axial portion extruded in a direction intersecting with the traveling direction of said carriage is provided for said connecting member, while said carriage is provided with a hole corresponding to said axial portion, and said connecting member and said carriage are connected by inserting said axial portion into the hole through said damper.

4. A recording apparatus according to claim 3, wherein said damper is formed by an almost cylindrical elastic member having an inner diameter allowing said axial portion to be inserted, and an outer diameter capable of being inserted into the hole, and by a flange nipped by said connecting member and said carriage.

5. A recording apparatus according to claim 4, wherein an extruded portion is provided for at least one of said connecting member and said carriage for compressing a part of said flange of said damper.

6. A recording apparatus according to claim 3, wherein a holding flange for holding said damper is formed integrally with said axial portion.

7. A recording apparatus according to claim 6, wherein said holding flange is structured so as not to be directly in contact with said carriage.

8. A recording apparatus according to claim 2, further comprising:

a fixing member for fixing said damper to said connecting member, wherein said fixing member is structured so as not to be directly in contact with said carriage.

9. A recording apparatus according to claim 1, wherein a plurality of said dampers are arranged in the traveling direction of said carriage.

10. A recording apparatus according to claim 1, wherein said recording head portion is provided with an ink jet recording head for recording by discharging ink.

11. A recording apparatus according to claim 10, wherein said recording head portion is provided with an electrothermal converting element for generating thermal energy as an energy generating element for generating energy to be utilized for discharging ink.

* * * * *

UNITED STATES PATENT AND TRADEMARK OFFICE

CERTIFICATE OF CORRECTION

PATENT NO. : 6,793,303 B2
DATED : September 21, 2004
INVENTOR(S) : Yasuhiko Ikeda It is certified that error appears in the above-identified patent and that said Letters Patent is hereby corrected as shown below:

Column 2,
Line 43, “FIG.4;.” should read -- FIG. 4; --.

Column 7,
Line 52, “83. Further,” should read -- 83. ¶Further, --.

Column 8,
Line 53, “damper. The” should read -- damper. ¶The --.

Signed and Sealed this

Seventeenth Day of May, 2005

JON W. DUDAS
*Director of the United States Patent and Trademark Office*